US006121724A

United States Patent [19]

Hasegawa et al.

[11] Patent Number: 6,121,724

[45] Date of Patent: Sep. 19, 2000

[54] COLOR CATHODE RAY TUBE WITH HIGH RESISTANCE FILM IN THE ELECTRON GUN

[75] Inventors: Takahiro Hasegawa, Gyoda; Shigeru Sugawara, Saitama-ken; Fumihito Suzuki, Fukaya, all of Japan

[73] Assignee: Kabushiki Kaisha Toshiba, Kawasaki, Japan

[21] Appl. No.: 09/106,348

[22] Filed: Jun. 29, 1998

[30] Foreign Application Priority Data

Jun. 30, 1997 [JP] Japan ..... 9-174192

[51] Int. Cl.[7] ..... H01J 29/88

[52] U.S. Cl. ..... 313/479; 313/412; 313/413

[58] Field of Search ..... 313/479, 412, 313/414

[56] References Cited

U.S. PATENT DOCUMENTS 5,536,997 7/1996 Van Hout ..... 313/479
5,952,777 9/1999 Sugawara et al. ..... 313/479

FOREIGN PATENT DOCUMENTS 5-205660 8/1993 Japan .

*Primary Examiner*—Vip Patel
*Assistant Examiner*—Karabi Guharay
*Attorney, Agent, or Firm*—Oblon, Spivak, McClelland, Maier & Neustadt, P.C.

[57] ABSTRACT

A high-resistance film having a plurality of pores and a resistance of $10^{10}$ to $10^{14}$ Ω is formed on the inner wall of the neck from a position where the high-resistance film contacts the inner conductive film to at least part of the inner wall surrounding at least the space between the grid farthest from a cathode to the grid second farthest from the cathode.

6 Claims, 4 Drawing Sheets

COLOR CATHODE RAY TUBE WITH HIGH RESISTANCE FILM IN THE ELECTRON GUN

BACKGROUND OF THE INVENTION

The present invention relates to a color cathode-ray tube and, more particularly, to stabilizing the inner wall potential in the neck of the cathode ray tube.

A color cathode-ray tube generally comprises an envelope made up of a panel, a funnel, and a neck, an inner conductive film formed from the inner wall of the funnel to the inner wall of the neck, and an electron gun assembly accommodated in the neck and having cathodes located at the end portion in the neck and a plurality of grids arrayed from the cathode side in order.

The most popular electron gun assembly is a so-called in-line electron gun assembly in which three electron guns align in line.

The electron gun comprises a beam generation portion called a triod portion constituted by a cathode, a first electrode, and a second electrode, and a main lens portion for focusing an electron beam on a screen. These electrodes are arranged at predetermined intervals (electrode gaps). The electron gun is sealed in a cylindrical neck portion having a diameter of, e.g., 20 to 40 mm in the rear portion of the cathode-ray tube.

An external voltage of about 110 volts is applied to the cathode of the electrodes of the triod portion through stem pins extending through the terminal portion of the neck to allow connection between the interior and the exterior of the tube. An external voltage of 0V is applied to the first electrode, and an external voltage of several hundred volts is applied to the second electrode.

An electron beam generated by the cathode passes through the beam transmission holes of the first and second electrodes and reaches the main lens. The electron beam is finally focused on the screen by the main lens.

The main lens is constituted by at least two electrodes. One of these electrodes is a final acceleration electrode connected to a high anode voltage through the inner conductive film formed on the inner surface of the neck. At least another electrode of the main lens is a convergence electrode to which a voltage 20 to 40% of the high anode voltage is applied through the stem pins.

The beam transmission holes of the final acceleration electrode and the convergence electrode generally oppose each other to have an interval of about 1 mm. The voltages described above are applied to these opposing beam transmission holes to form the main lens, thereby focusing the beam on the screen.

These electrodes are fixed and supported by insulating supports made up of glass or the like.

The projecting portions (straps) of the respective electrodes are embedded in the insulating supports to fix and support the respective electrodes. These straps are generally formed on the center gun of the three electron guns.

In the color cathode-ray tube having the above electron gun assembly, even the inner surface portion not coated with the inner conductive film is gradually charged up to the high anode voltage of the inner conductive film by the inner conductive film coated on the inner surface of the neck. The inner surface portion not coated with the inner conductive film stabilizes at a given potential within several ten minutes to several hours.

When an electron beam is emitted by the cathode, scattered electrons leaking from the electrode gap or the like without passing through each electrode beam transmission hole collide against the inner surface of the neck to emit secondary electrons from the inner surface of the neck, thereby undesirably varying the neck potential.

The neck potential penetrates through each gap between the electrodes constituting the electron gun, and the trajectory of the electron beam changes due to the variations in neck potential.

This penetration of the neck potential occurs from the entire inner surface of the neck. However, the center gun assembly is located at nearly the center of the neck; the Coulomb forces generated by the neck potential almost balance each other in this assembly, and the trajectory of the center beam is hardly affected by the neck potential. As the inner surface of the neck is located symmetrically in the vertical direction, the trajectory of each side beam in the vertical direction changes little for the same reason in a direction perpendicular to the array direction of the three electron guns (this direction is also referred to as the vertical direction hereinafter).

Of the changes in beam trajectories by the penetration of the neck potential, a change in trajectory of the side beam in the horizontal direction which has an asymmetrical relationship with the inner surface of the neck poses a practical problem. A so-called convergence drift occurs due to this change, resulting in color misregistration.

The change in beam trajectory by the penetration of the neck potential is the largest in the main lens portion having a largest electrode gap and closest to the internal conductive film.

A means for removing the convergence drift generated by the neck potential is to reduce the electrode gap to make it difficult for the neck potential to penetrate. However, the electrode gap cannot be excessively reduced in consideration of the withstanding voltage characteristics between the electrodes. The above means is not an effective means.

Another means is to increase the outer diameter of each electrode constituting the electron gun and make it difficult for the neck potential to penetrate. However, the inner diameters of the neck and the insulating supports which support the electrodes are limited. The outer diameter of each electrode cannot be simply increased, and a sufficient effect cannot be obtained.

Still another means is a technique proposed by Jpn. Pat. Appln. KOKAI Publication No. 5-205660 to form a high-resistance film connected to an inner conductive film, i.e., a film in which a conductive material is dispersed in an insulator film serving as a base material, thereby stabilizing the neck potential. The resistance of the high-resistance film must be extremely high in consideration of the withstanding voltage characteristics and must fall within the range of, e.g., about $10^{10}$ to about $10^{14}$ Ω. To increase the resistance, the amount of insulator in the high-resistance film must be increased. Such increase in the amount of insulator in the high-resistance film promotes emission of secondary electrons from the scattered electrons. The convergence drift cannot be perfectly eliminated.

BRIEF SUMMARY OF THE INVENTION

A conventional color cathode-ray tube suffers a convergence drift generated by a change in beam trajectory of a side gun upon charge-up of the inner surface potential of the neck.

If the gap of a main lens portion is decreased or the outer diameter of parts of an electrode is increased in order to prevent the convergence drift, it becomes difficult to change the design so as to obtain a sufficient effect when maintenance of sufficient breakdown voltage characteristics and mechanical limitations on the insulating supports which support the electrodes are taken into consideration.

To stabilize the neck potential by forming a high-resistance film on the inner surface of the neck, the resistance of the high-resistance film must be increased, and the convergence drift generated by the scattered electrons cannot be perfectly eliminated.

The present invention has been made in consideration of the above situation, and has as its object to provide a color cathode-ray tube essentially free from a convergence drift due to charge-up of the inner wall potential of a neck and collision of scattered electrons against the inner wall of the neck.

According to the present invention, there is provided a color cathode-ray tube comprising an envelope constituted by a panel, a funnel, and a neck, an inner conductive film formed from an inner wall of the funnel to part of an inner wall of the neck, and an in-line electron gun accommodated in the neck and having cathodes located at an end portion in the neck and a plurality of grids arrayed in order from a cathode side at an interval enough to form an electron lens, wherein a high-resistance film having a higher electric resistance than that of the inner conductive film is formed on the inner wall of the neck from a position where the high-resistance film contacts the inner conductive film to at least that part of an inner wall portion, which surrounds a space between a grid farthest from the cathode and a grid second farthest from the cathode, and the high-resistance film is a porous film including a plurality of pores and has a resistance between two ends of the high-resistance film along a direction of tube axis to fall within a range of $10^{10}$ to $10^{14}$ Ω.

According to the present invention, the high-resistance film having a plurality of pores and a resistance of $10^{10}$ to $10^{14}$ Ω is formed in the color cathode-ray tube so as to cover the inner wall from the inner conductive film in the neck to at least part of the main lens. The convergence drifts by charge-up of the inner wall potential in the neck and collision of scattered electrons against the inner wall of the neck can be greatly reduced. Therefore, this color cathode-ray tube has a great industrial advantage.

Additional objects and advantages of the invention will be set forth in the description which follows, and in part will be obvious from the description, or may be learned by practice of the invention. The object and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate a presently preferred embodiment of the invention and together with the general description given above and the detailed description of the preferred embodiment given below, serve to explain the principles of the invention.

DETAILED DESCRIPTION OF THE INVENTION

In a color cathode-ray tube according to the present invention, a high-resistance film having a plurality of pores and a resistance of $10^{10}$ to $10^{14}$ Ω is formed from the neck-inner-wall-side position of an inner conductive film formed from the inner wall of a funnel to part of the inner wall of a neck to at least part of an inner wall surrounding the space between a grid farthest from a cathode and a grid second farthest from the cathode so as to cover at least part of the main lens portion of an electron gun assembly.

When the high-resistance film having a plurality of pores is used as described above, the distance between the conductive masses in the high-resistance film formed on the inner wall of the neck can be increased. The resistance of the high-resistance film can be increased to a predetermined value, i.e., $10^{10}$ to $10^{14}$ Ω. At the same time, the ratio of the insulating material to the conductive material in the high-resistance film need not be changed.

The high-resistance film is used and at least formed from the neck-inner-wall-side position of the inner conductive film formed from the inner wall of the funnel to part of the inner wall of the neck to at least part of the inner wall surrounding the space between the grid farthest from the cathode to the grid second farthest from the cathode so as to cover at least the main lens portion of the electron gun assembly. A change in beam trajectory due to neck potential penetration at least at the main lens portion having a largest change in beam trajectory can be prevented. Therefore, the convergence drift can be effectively prevented.

The resistance can be increased without increasing the amount of insulating material in the high-resistance film. Even if scattered electrons collide against the inner wall of the neck, they can reach the conductive material in the high-resistance film through the fine pores in the film. The probability of secondary electron emission can be greatly reduced, and the convergence drift can be greatly improved.

A color cathode-ray tube according to the present invention will be described in detail with reference to the accompanying drawing.

Figure 1:
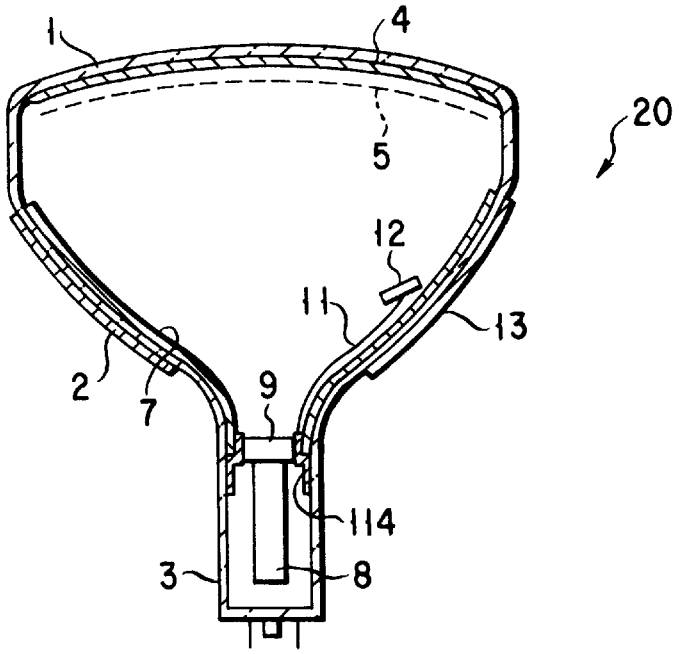
FIG. 1 is a schematic view showing a color cathode-ray tube according to an embodiment of the present invention.

FIG. 1 is a schematic view showing a color cathode-ray tube according to an embodiment of the present invention. As shown in FIG. 1, a general color cathode-ray tube 20 has an envelope comprised of a panel 1, a funnel 2, and a neck 3. A phosphor screen 4 made up of stripe- or dot-like phosphor layers for emitting red, green, and blue beams, and a metallized screen is formed on the inner surface of the panel 1 in the envelope. A shadow mask 5 opposes the phosphor screen 4 at a predetermined interval. An inner conductive film 7 electrically connected to an anode terminal formed in the funnel 2 is formed on the inner surface from the funnel 2 to the neck 3, and a getter 12 and a getter support 11 are disposed.

An electron gun assembly 8 is mounted in the neck 3. A valve spacer is placed in a convergence electrode 9 of the electron gun assembly 8 so as to contact the inner conductive film 7. An external conductive film 13 is formed on the outer wall of the funnel 2.

A high-resistance film 114 having an electric resistance higher than that of the inner conductive film 7 is formed on the inner wall of the neck 3 so as to contact the inner conductive film 7.

The high-resistance film 114 has a plurality of pores and a resistance of $10^{10}$ to $10^{14}$ Ω. The high-resistance film is formed from the neck-inner-wall-side position of the inner conductive film formed from the inner surface of the funnel to part of the inner wall of the neck to at least the inner wall surrounding the space between the grid farthest from the cathode to the grid second farthest from the cathode.

Figure 2:
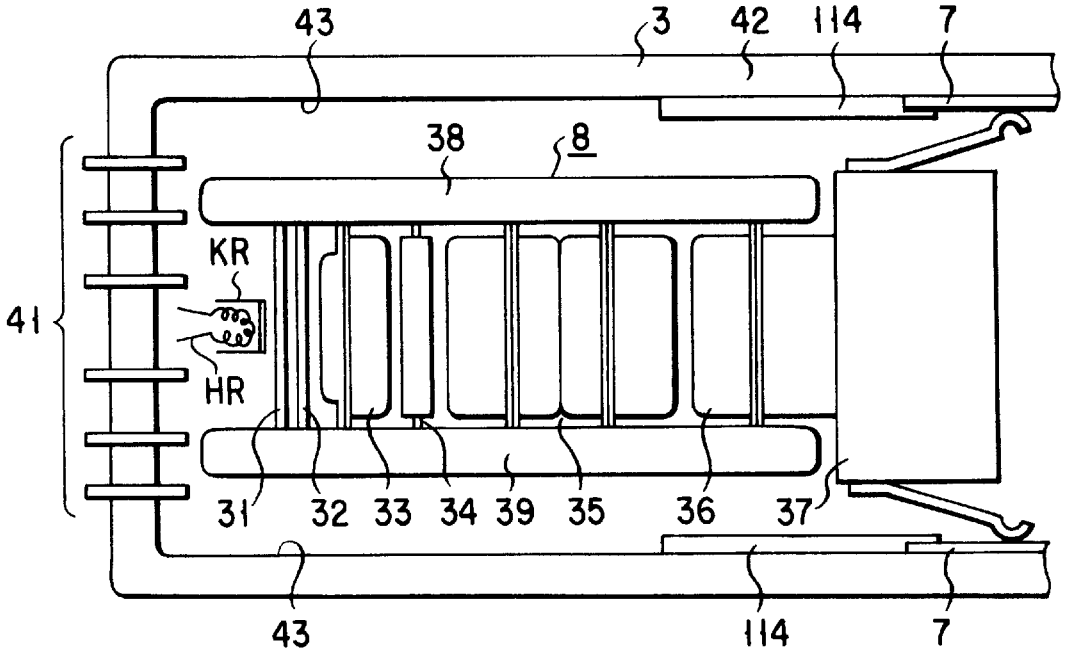
FIG. 2 is an enlarged schematic view of a neck shown in FIG. 1.

FIG. 2 is an enlarged view of the neck 3. Three cathodes KR, KG (not shown), and KB (not shown) are formed in the end portion of the neck 3. Heaters HR, HG (not shown), and HB (not shown) are contained in the cathodes KR, KG, and KB, respectively. A first electrode (grid) 31, a second electrode (grid) 32, a third electrode (grid) 33, a fourth electrode (grid) 34, a fifth electrode (grid) 35 serving as a converging electrode, a sixth electrode (grid) 36 serving as a final accelerating electrode, and a shield cup 37 are arrayed from the cathode to the neck direction in the order named. The electrodes except the shield cup 37 are arranged at predetermined intervals so as to form an electron lens. These electrodes extend from two insulating supports 38 and 39 and are simultaneously fixed and supported by them. Note that the shield cup 37 is welded and fixed to the sixth electrode 36.

A nearly circular opening is formed in each of the first electrode 31 to the sixth electrode 36 in correspondence with one cathode. Openings having a diameter of 1 mm or less are formed in the first and second electrodes 31 and 32. The opening of the third electrode 33 on the second electrode 32 side is larger than the approximately 2-mm diameter opening of the second electrode 32. Relatively large openings 5 to 6 mm diameter are formed from the third electrode 33 on the fourth electrode 34 side to the sixth electrode 36.

This electron gun assembly 8 is sealed in the cylindrical neck portion 3 having a diameter around 20 to 40 mm in the rear portion of the cathode-ray tube. The electron gun assembly 8 is supported by stem pins 41 extending in the terminal portion of the neck, and the electrodes except the sixth electrode 36 are applied with external predetermined voltages through the stem pins 41.

In the above arrangement, for example, a voltage obtained by superposing a video signal corresponding to an image on a DC voltage of about 150V is applied to the cathodes KR, KG, and KB. The first electrode 31 is grounded. The second electrode 32 is connected to the fourth electrode 34 in the tube, and a DC voltage of about 800V is applied to the second and fourth electrodes 32 and 34. The third electrode 33 is connected to the fifth electrode 35 serving as the main converging electrode in the tube, and a DC voltage of about 6 to 9 kV is applied to the third and fifth electrodes 33 and 35. A high anode voltage of about 30 kV is applied to the sixth electrode 36 through the inner conductive film 7 formed on an inner wall 43 of the neck and then to the shield cup 37.

Electron beams emitted by the cathodes KR, KG, and KB cross over near a position from the second electrode 32 to the third electrode 33 and then diverge. The divergent beams are preliminarily converged by a prefocus lens formed by the second and third electrodes 32 and 33. The convergent beams are further preliminarily converged by an auxiliary lens formed by the third, fourth, and fifth electrodes 33, 34, and 35. The beams are finally formed into a beam spot on the screen by the main lens formed by the fifth and sixth electrodes 35 and 36.

The inner conductive film 7 formed on the inner wall 43 of the neck is formed up to the intermediate portion of the shield cup 37 along the direction of tube axis. The high-resistance film 114 is formed on the inner wall of the neck so as to be connected to the inner conductive film 7 and cover the inner wall from the sixth electrode 36 to the end face of the fifth electrode 35 on the sixth electrode 36 side. The original glass material is exposed on the inner wall of the neck from the end of the high-resistance film 114 to the stem pins 41.

A CR integrating circuit is formed by the resistances of the high-resistance film 114 and neck glass 42, and the stray capacitance. The potential of the high-resistance film 114 stabilizes at a given potential determined by the resistances of the high-resistance film 114 and the neck glass 42 and the stray capacitance.

As the resistance of the high-resistance film 114 decreases, the potential of the high-resistance film 114 stabilizes quicker. When the resistance of the high-resistance film 114 is excessively reduced, leakage occurs between the high-resistance film 114 and the fifth electrode 35 to degrade the breakdown voltage characteristics. The resistance of the high-resistance film 114 preferably falls within the range of $10^{10}$ to $10^{14}$ Ω, and more preferably $10^{10}$ to $10^{13}$ Ω.

Variations in inner wall potential of the neck are transmitted through the electrode gaps for forming the electron lens of the electron gun assembly. This changes the trajectories of the side beams. The main lens portion formed by the fifth and sixth electrodes 35 and 36 has a largest electrode gap and is located close to the inner conductive film 7. The main lens portion is susceptible to the influence of the inner wall potential of the neck which is charged up to a relatively high potential. For this reason, the change in trajectory of each side beam is the largest at the main lens portion constituted by the fifth and sixth electrodes 35 and 36. The high-resistance film 114 is formed to cover the main lens portion from a portion where the high-resistance film 114 contacts the inner conductive film to the inner wall surrounding the space between the sixth electrode farthest from the cathode constituting the main lens portion to the fifth electrode second farthest from the cathode. The neck potential near the main lens portion charged up by the high anode voltage can be stabilized within a short period of time, and the changes in trajectories of the side beams can be converged within a short period of time.

The high-resistance film 114 is formed as follows. Neck glass is coated with a high-resistance film coating solution obtained by mixing 1 wt % of a conductive material such as tin oxide, 2 wt % of an insulating material (e.g., ethyl silicate of 2 wt % silicon oxide) having adhesion properties for the conductive material and neck glass, and 0.3 wt % of an organic coloring agent (e.g., an azo-based pigment) having a particle size of 0.1 to 1 nm, thereby forming a coating film. The coating film is then baked to obtain the high-resistance film 114.

Figure 3:
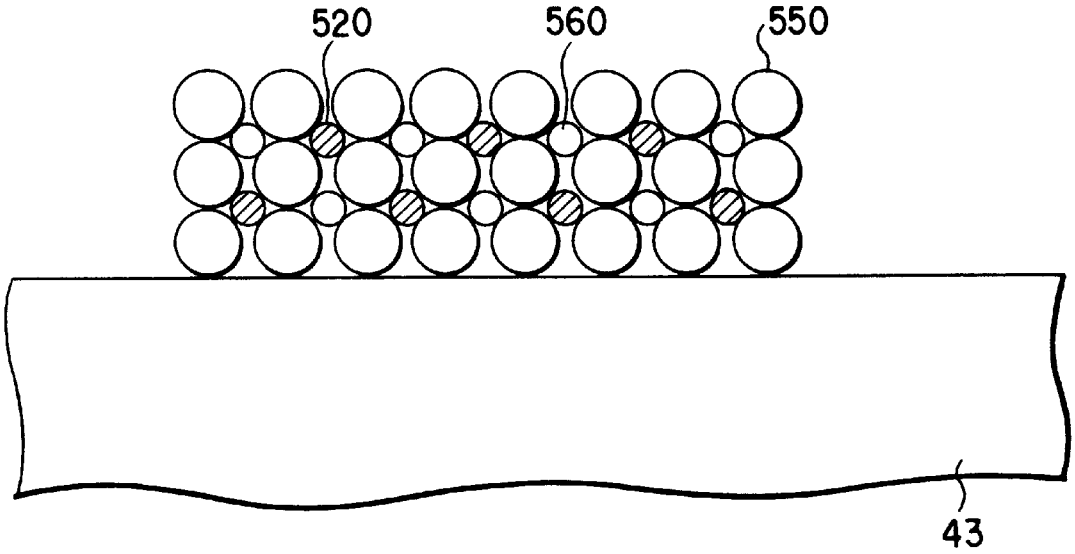
FIG. 3 is a view showing a model of a coating film structure for a high-resistance film used in the present invention.

FIG. 3 is a view showing a model of a coating film structure for the high-resistance film used in the present invention.

As shown in FIG. 3, in the coating film, a conductive material 520 and an organic coloring agent 560 are dispersed at nearly equal intervals in an insulating material 550 serving as a base material.

Figure 4:
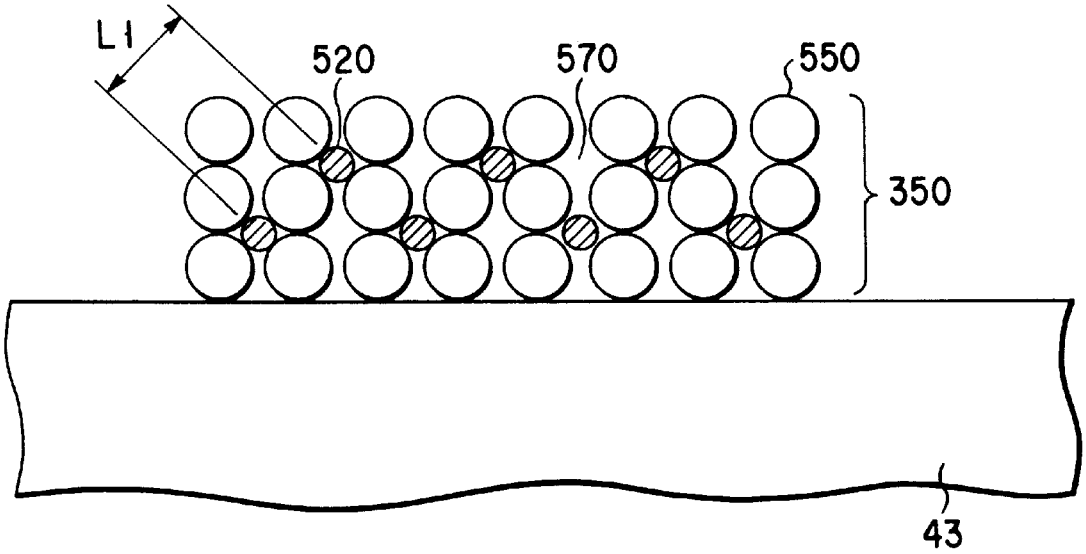
FIG. 4 is a view showing a model of a high-resistance film structure obtained by baking the coating film shown in FIG. 3.

FIG. 4 is a view showing the model of a high-resistance film structure obtained by baking the coating film shown in FIG. 3.

As shown in FIG. 4, upon baking, most of the organic coloring agent 560 in the film evaporates, and the locations where the organic coloring agent 560 was present become pores 570. The minimum distance between the particles of the conductive material 520 is L1.

Figure 5:
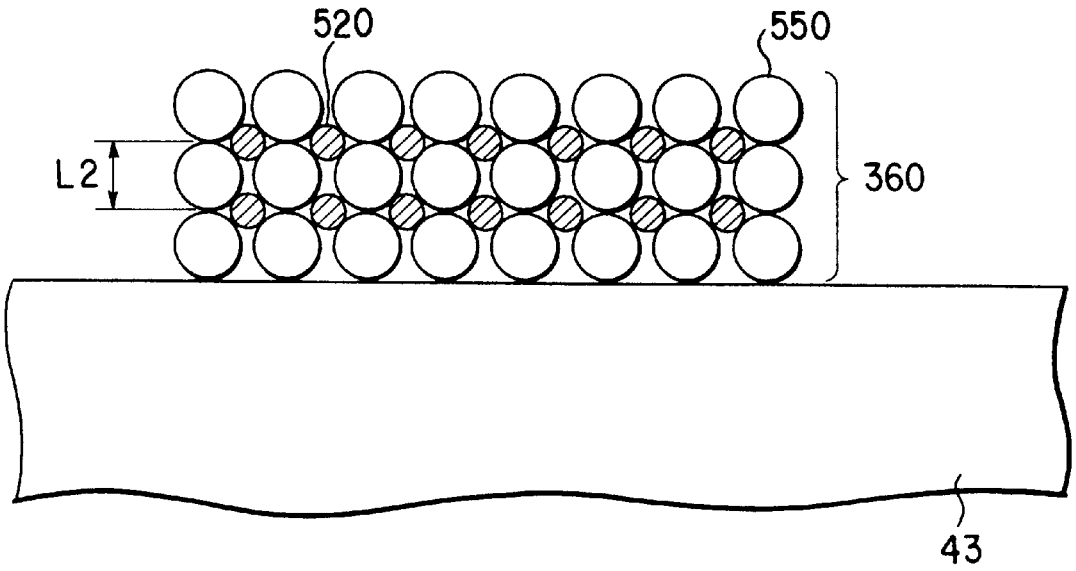
FIG. 5 is a view showing a model of a high-resistance film structure obtained by baking a coating film not containing an organic coloring agent.

FIG. 5 is a view showing a model of a film structure of a comparative example obtained when neck glass is coated with a coating solution containing a conductive material and an insulating material, but not containing an organic coloring agent, and the resultant film is baked. As shown in FIG. 5, when no organic coloring agent is contained in the coating film, a high-resistance film 350 obtained upon baking the coating film has the conductive material 520 at locations supposed to become the pores 570 upon evaporation of the organic coloring agent 560 as shown in FIG. 4.

As can be apparent from a comparison between FIGS. 4 and 5, the minimum distance L1 between the particles of the conductive material 520 in the coating solution containing the organic coloring agent 560 is larger by the presence of the pores 570 than a minimum distance L2 between the particles of the conductive material 520 in the coating solution not containing the organic coloring agent 560. The organic coloring agent 560 is mixed to form the pores 570 in the high-resistance film 350, thereby increasing the resistance of the high-resistance film 350 without increasing the amount of insulating material 550.

Figure 6:
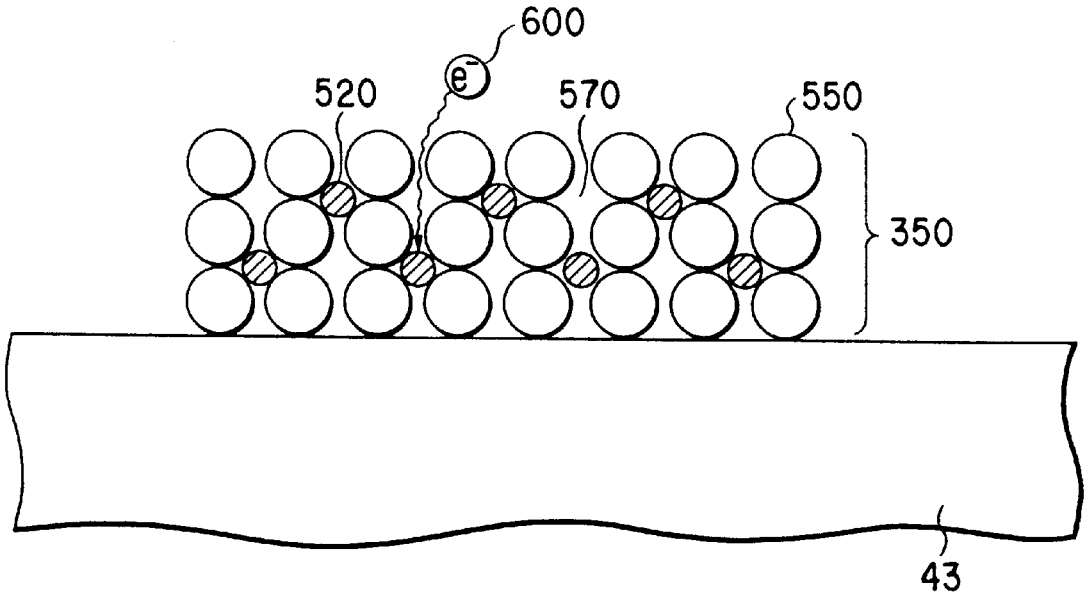
FIG. 6 is a view for explaining collision of a scattered electron against a high-resistance film used in the present invention.

A case in which scattered electrons leaking from the electrode gaps or the like collide against the high-resistance film 350 will be described with reference to FIG. 6. According to the present invention, as shown in FIG. 6, a scattered electron 600 colliding against the high-resistance film 350 more readily reaches the conductive material 520 through the pores 570 of the high-resistance film 350. The electron that has reached the conductive material 520 is absorbed by the high anode voltage through the high-resistance film 350. Therefore, the probability of secondary electron emission can be greatly reduced.

As described above, the organic coloring agent 560 is mixed to form the pores 570 in the high-resistance film 350. A desired resistance can be obtained while preventing secondary electrons from being emitted upon collision of scattered electrons against the high-resistance film 350. In addition, the neck potential can be stabilized quickly. When the high-resistance film 350 is formed as described above, the convergence drift can be greatly improved.

In the embodiment shown in FIG. 2, the high-resistance film 114 is formed on the inner wall of the neck so as to cover the main lens portion formed by the fifth and sixth electrodes 35 and 36. However, the present invention is not limited to this. The length of the high-resistance film in the direction of the tube axis is not limited to a specific value.

Figure 7:
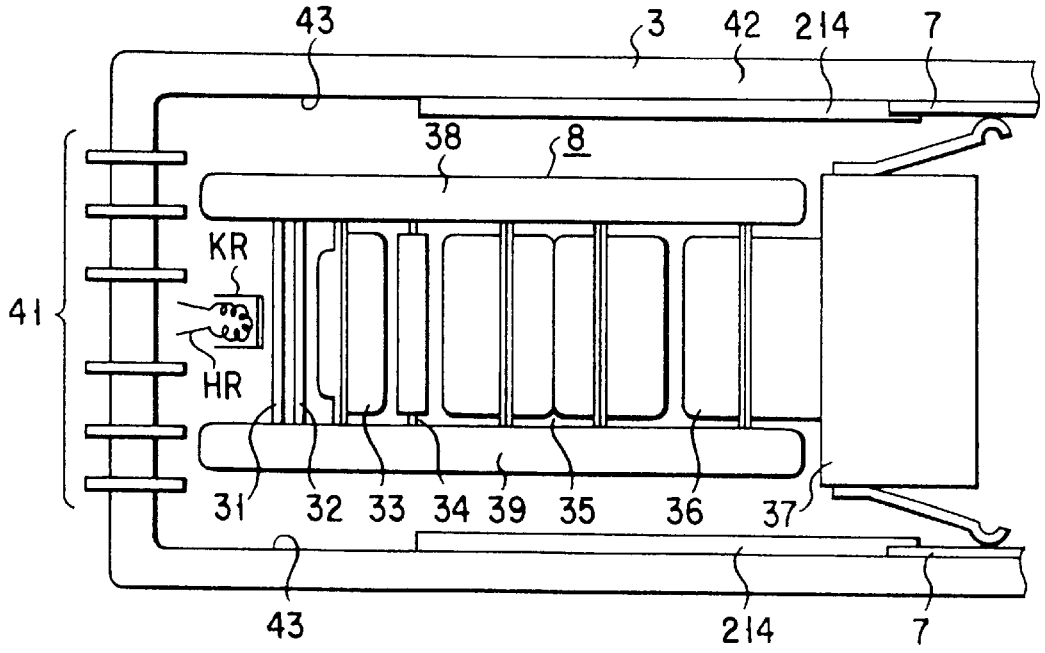
FIG. 7 is a schematic view of the neck portion of a color cathode-ray tube according to another embodiment of the present invention.
Figure 8:
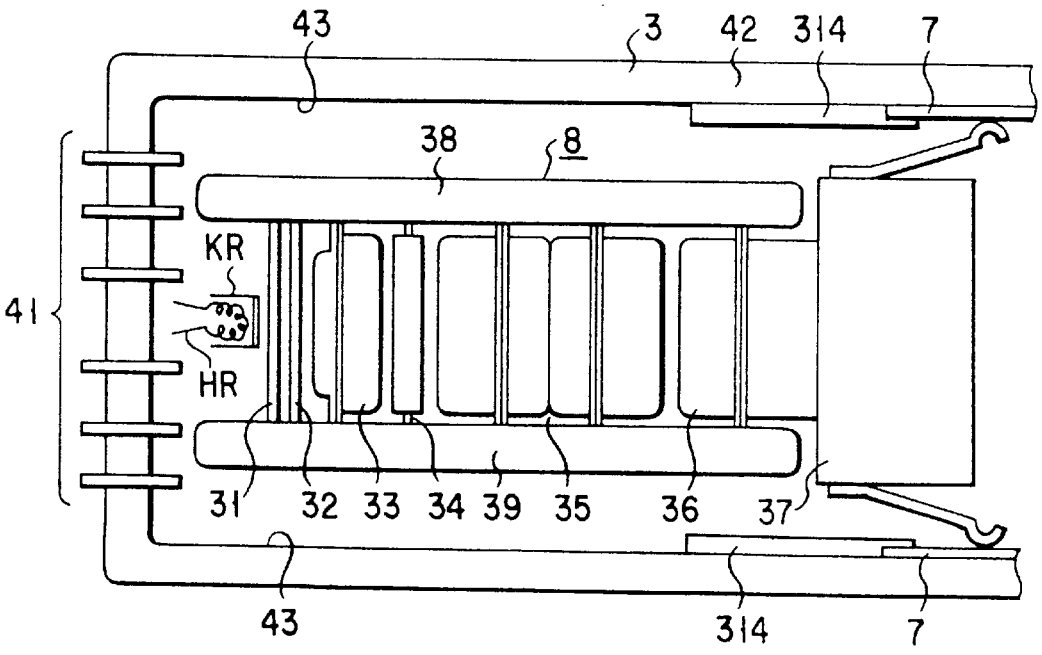
FIG. 8 is a schematic view of the neck portion of a color cathode-ray tube according to still another embodiment of the present invention.

FIGS. 7 and 8 are schematic views showing neck portions of color cathode-ray tubes according to other embodiments of the present invention.

The neck portion in FIG. 7 is the same as that of FIG. 2 except that a high-resistance film 214 is formed long enough to cover a fourth electrode 35. The neck portion in FIG. 8 is the same as that of FIG. 2 except that a high-resistance film 314 is formed short enough to cover part of the main lens portion constituted by fifth and sixth electrodes 35 and 36.

In each embodiment, an organic coloring agent was used to form fine pores in the high-resistance film. Preferable examples of the organic coloring agent are azo pigments such as Congo Red and Indigo.

Any organic material which does not evaporate at room temperature and evaporates upon baking can be preferably used. Examples of this material are potassium carbonate, magnesium carbonate, and potassium hydrogen carbonate.

Examples of the conductive material are tin oxide and a mixture obtained by mixing indium oxide or antimony oxide in tin oxide.

An example of the insulating material is preferably silicon oxide.

The high-resistance film preferably has a porosity of not more than 30%, and more preferably 20 to 30%. When the porosity is not more than 20%, an effect on increase of resistance due to pores in the resistance film can be not obtained sufficiently. When the porosity exceeds 30%, strength of film is decreased.

The diameter of each of the plurality of pores preferably falls within the range of 0.1 to 0.5 nm. Within this range, strength of the high-resistance film having pores can be almost equal with strength of a film having no pores, thus obtaining an excellent effect.

To obtain a high-resistance film having the above pore diameter range, when a pigment is used as an organic material, a pigment having a particle size falling within the range of 0.1 to 0.5 nm is preferably used.

In each embodiment described above, the basic structure of the electron gun assembly is of QPF (Quadra Potential Focus). The present invention is not limited to any specific basic structure of the electron gun.

In each embodiment described above, the diameter of the neck portion in which the electron gun assembly is sealed is not specified. The present invention is applicable to a neck having any diameter.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode-ray tube comprising an envelope formed by a panel, a funnel, and a neck, with an inner conductive film being formed from an inner wall of said funnel to part of an inner wall of said neck, and an in-line electron gun is accommodated in said neck, said in-line electron gun having cathodes located at an end portion in said neck and a plurality of grids arrayed in order from a cathode side at an interval sufficient to form an electron lens, wherein a high-resistance film having a higher electric resistance than that of said inner conductive film is formed on said inner wall of said neck from a position where said high-resistance film contacts said inner conductive film to at least that part of an inner wall portion which surrounds a space between a grid farthest from said cathode and a grid second farthest from said cathode, and said high-resistance film is a porous film including a plurality of pores having a diameter falling within a range of 0.1 to 1 nm and has a resistance between two ends of said high resistance film along a direction of the tube axis within a range of $10^{10}$ to $10^{14}$ Ω, and further wherein said high-resistance film having said plurality of pores formed by coating said inner surface and said neck with a coating solution containing a conductive material and an organic coloring material chemically stable at room temperature to form a coating film, and baking said coating film to evaporate the organic coloring material.

2. A tube according to claim 1, wherein the organic coloring material essentially consists of an azo pigment.

3. A tube according to claim 2, wherein a particle size of the pigment falls within a range of 0.1 to 1 nm.

4. A tube according to claim 1, wherein the conductive material is a material selected from the group consisting of tin oxide, a mixture of tin oxide and indium oxide, and a mixture of tin oxide and antimony oxide.

5. A tube according to claim 1, wherein the resistance falls within a range of $10^{11}$ to $10^{13}$ Ω.

6. A tube according to claim 1, wherein said high-resistance film having a plurality of pores has a porosity not more than 30%.

* * * * *